United States Patent [19]

King et al.

[11] Patent Number: 4,610,549

[45] Date of Patent: Sep. 9, 1986

[54] METHOD AND APPARATUS FOR GENERATING A TIMING SIGNAL IN A TIME-OF-ARRIVAL DETECTION SYSTEM

[75] Inventors: Dennis D. King, Sandy; David F. Dautel, W. Bountiful, both of Utah

[73] Assignee: E-Systems, Inc., Dallas, Tex.

[21] Appl. No.: 730,560

[22] Filed: May 6, 1985

[51] Int. Cl.[4] ..... G04F 8/00

[52] U.S. Cl. ..... 368/113

[58] Field of Search ..... 368/113, 118, 120; 343/5 LS, 7 R, 10, 12 R

[56] References Cited

U.S. PATENT DOCUMENTS

| | | | |
|---|---|---|---|
| 3,337,808 | 8/1967 | Kahn | 325/474 |
| 3,413,412 | 11/1968 | Townsend | 178/7.1 |
| 3,432,757 | 3/1969 | Trippe | 325/322 |
| 3,603,884 | 9/1971 | Zaura et al. | 325/340 |
| 3,852,671 | 12/1974 | Risley | 325/492 |
| 3,978,412 | 8/1976 | Frerking | 325/478 |
| 4,000,466 | 12/1976 | Scouten et al. | 368/113 |
| 4,063,180 | 12/1977 | Norman | 328/112 |
| 4,143,325 | 3/1979 | Kahn | 325/478 |
| 4,322,832 | 3/1982 | Sartorius | 368/113 |

OTHER PUBLICATIONS

R. J. Kelly, System Consideration for the New DME/P International Standard, vol. AES-20, No. 1, pp. 2-23.

*Primary Examiner*—Vit W. Miska

*Attorney, Agent, or Firm*—Albert M. Crowder, Jr.

[57] ABSTRACT

A noise pulse rejection circuit for use in a pulse type time-of-arrival detection system is described. Preferably, the pulse type time-of-arrival detection system includes a precision distance measuring equipment (DME/P) receiver having a delay-attenuate-compare (DAC) detector. The DAC detector produces first time-of-arrival detector outputs due to receiver noise, and a second time-of-arrival detector output upon detection of a received DME pulse having a leading edge, each of the first time-of-arrival detector outputs having a substantially shorter period than the period of the second time-of-arrival detector output. The noise pulse rejection circuit preferably includes a monostable multivibrator, which is triggered by the first and second time-of-arrival detector outputs to generate a timing signal having first and second logic states, the timing signal normally changing from a first logic state to a second logic state after a predetermined time period "T". Because the output of the monostable multivibrator has a longer period than the period of each time-of-arrival detector output, the monostable multivibrator can only "time-out" upon reception of the desired pulse.

8 Claims, 5 Drawing Figures

METHOD AND APPARATUS FOR GENERATING A TIMING SIGNAL IN A TIME-OF-ARRIVAL DETECTION SYSTEM

TECHNICAL FIELD

The present invention relates to pulse detection and more particularly to a method and apparatus for generating a timing signal in a time-of-arrival pulse detection system.

BACKGROUND OF THE INVENTION

Microwave landing systems facilitate aircraft approach and landing operations. Such systems include so-called precision distance measuring equipment (DME/P) which provides aircraft distance information by measuring total round-trip time between pulse interrogations from an airborne transmitter and replies from a ground transponder. This type of system is capable of providing high accuracy ranging information in the severe multipath environment encountered during landing operations.

Range measurements in the airborne transmitter and replay delay timing in the ground transponder requires detection of the transmitted and received DME interrogation pulses. Accurate methods for estimating the time-of-arrival (TOA) of such pulses are thus critical to achieving useful ranging information. One such method for determining DME pulse time-of-arrival utilizes a so-called delay, attenuate and compare (DAC) detector, which functions to compare a delayed version of the DME pulse to an attenuated version thereof. A pulse time-of-arrival detector output is declared when the delayed signal exceeds the attenuated signal. This output is then used for timing purposes in the remainder of the decoding process.

Prior art microwave landing systems incorporating a DAC detector in the DME/P receiver provide reasonably adequate detection of the DME pulse. However, the DAC detector also produces time-of-arrival outputs due to noise generated in the DME/P receiver. Such outputs are undesirable because they adversely affect the timing in the remainder of the decoding process.

There is therefore a need to provide a method and apparatus for generating a timing signal for use in a time-of-arrival detection system which properly represents a pulse detection rather than receiver noise detections.

BRIEF SUMMARY OF THE INVENTION

Accordingly, the present invention relates to a method and apparatus for generating a timing signal in a time-of-arrival detection system, this system preferably including a DME/P receiver having a DAC detector. According to the preferred embodiment, the present invention takes advantage of the substantially shorter periods between time-of-arrival detector outputs due to receiver noise and the time-of-arrival detector output occurring upon detection of the DME pulse. A noise pulse rejection circuit is provided to exploit this difference in the time-of-arrival detector output periods to generate the system timing signal.

Preferably, the noise pulse rejection circuit includes a retriggerable network which is triggered by the time of arrival detector outputs to generate a timing signal having first and second logic states, the timing signal normally changing from the first logic state to the second logic state after a predetermined time period "T".

The time period "T" is substantially longer than the period of the time-of-arrival detector outputs due to receiver noise. Accordingly, the time-of-arrival detector outputs due to receiver noise continually trigger the retriggerable network before this circuit can "time-out," and thus, the timing signal remains in the first logic state. However, when the time-of-arrival detector output from the DAC detector represents a leading edge of the received DME pulse, detector outputs due to receiver noise do not occur for a period of time because the presence of the pulse prevents further noise detections. Therefore, the retriggerable network "times-out," causing the timing signal to change from the first logic state to the second logic state. A negative going edge of the timing signal is then used for timing purposes in the remainder of the decoding process.

BRIEF DESCRIPTION OF THE DRAWINGS

For a more complete understanding of the present invention, reference is now made to the following Description taken in conjunction with the accompanying drawings, in which.

DETAILED DESCRIPTION

Figure 1:
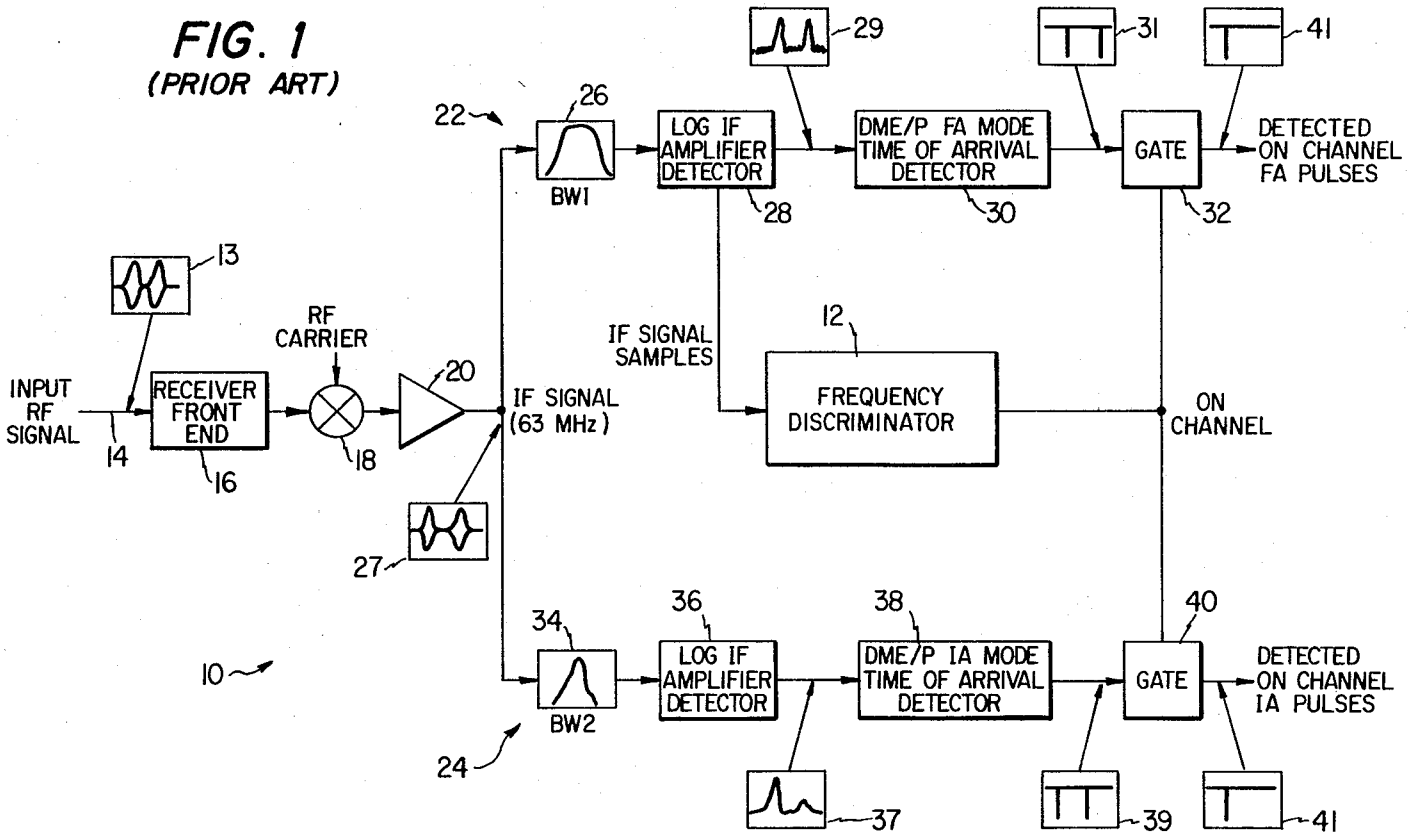
FIG. 1 (PRIOR ART)
FIG. 1 is a block diagram of a precision distance measuring equipment (DME/P) receiver of the prior art.

With reference now to the figures, wherein like reference characters designate like or similar parts throughout the several views, FIG. 1 is a block diagram of a precision distance measuring equipment (DME/P) receiver 10, which may be incorporated in a ground transponder of a microwave landing system (MLS). The DME/P receiver includes a frequency discriminator circuit, designated generally by the reference numeral 12, for determining whether the received signal pulses are centered on a desired received frequency. The DME/P receiver 10 receives an RF signal 13 on line 14, which is applied to conventional receiver front end circuitry 16 for initial signal processing. The RF signal input on line 14 preferably includes a pair of interrogation pulses for facilitating aircraft range determination. Each interrogation pulse is normally approximated by a $\cos^2/\cos^2$ envelope.

The output of the receiver front end circuitry 16 is applied to one input of a mixer 18, the other input thereto being an RF carrier signal. The mixer 18 translates the RF input signal to IF, and the output thereof is amplified in amplifier 20 and applied directly to two parallel signal processing channels, 22 and 24. The first signal processing channel 22 provides a so-called wideband final approach (FA) mode of operation, while the second signal processing channel 24 provides a so-called narrowband initial approach (IA) mode of operation.

Specifically, the DME/P receiver 10 of FIG. 1 operates in a two-pulse/two-mode fashion. The wideband final approach (FA) mode is utilized for aircraft ranges up to seven (7) nautical miles from the transponder, which satisfies adjacent channel power constraints on the transponder while maintaining adequate receiver threshold-to-noise ratio. When the aircraft is between seven (7) and twenty-two (22) nautical miles from the transponder, however, the narrowband initial approach (IA) mode is used. The proper interrogation mode is determined by the transponder through an interrogation code, with transponder reply delay timing based on a proper threshold point for the type of interrogation received. In the region between seven (7) and eight (8) nautical miles from the transponder, an approaching aircraft interrogator transmits in both the IA and FA modes to effect a smooth transition to the FA mode by the time the aircraft reaches the seven (7) nautical mile point. The first and second processing channels 22 and 24 are provided to facilitate processing of the received RF signal during the FA and IA operational modes.

Referring back to FIG. 1, the first signal processing channel 22 includes a multipole wideband bandpass filter 26, of bandwidth BW1, for filtering the IF signal 27 produced by an amplifier 20. The output of filter 26 is applied to a logarithmic IF amplifier/detector 28, which generates a wideband mode (FA) signal. The FA mode signal 29 is then fed to a time-of-arrival (TOA) detector 30, which creates logic pulses corresponding with the time-of-arrival of each pulse of the receiver 10. The output 31 of the time-of-arrival detector 30 is then applied to a gate circuit 32, control of which is effected by the frequency discriminator circuit 12, as will be described.

The second signal processing path 24 of the DME/P receiver 10 includes a multipole narrowband filter 34, of bandwidth BW2, for filtering the IF signal 27 from amplifier 20. The output of the filter 34 is fed to a logarithmic IF amplifier/detector 36, which generates a narrowband mode (IA) signal 37 proportional to the logarithm of the signal output from the filter 34. The IA mode signal 37 output from the logarithmic IF amplifier/detector 36 is then applied to an IA mode time-of-arrival detector 38, which generates logic pulses corresponding with the time-of-arrival of each pulse at the receiver 10. The output 39 of the time-of-arrival detector 38 is applied to a gate circuit 40, control of which is also effected by the frequency discriminator circuit 12, as will be described.

Specifically, the logical detected pulses 31 and 39 output from the time-of-arrival detectors 30 and 38 are gated on or off depending on the output of the frequency discriminator circuit 12. In operation, the discriminator circuit 12 receives IF signal samples from the logarithmic IF amplifier/detector 28. If the received interrogation pulses are "on-channel," i.e., centered on a desired received frequency, the control gates 32 and 40 are opened by the discriminator circuit 12, allowing the logical detected pulses output from the time-of-arrival detectors 30 and 38 to be passed to the remainder of the receiver to facilitate further decoding of the received interrogation pulses. In particular, the pulses 41 output from control gates 32 and 40 form timing signals which control appropriate decoding circuits (not shown) in the receiver.

The prior art DME/P receiver 10 of FIG. 1 provides reasonably adequate detection of the DME interrogation pulses. However, during the FA operational mode the time-of-arrival detector circuit 30 produces time-of-arrival outputs due to noise generated in the receiver circuitry. Such outputs are undesirable because they adversely affect the timing in the remainder of the decoding process. There is therefore a need to provide an improved method and apparatus for generating a timing signal in a time-of-arrival detection system which properly represents a pulse detection rather than receiver noise detections.

Figure 2:
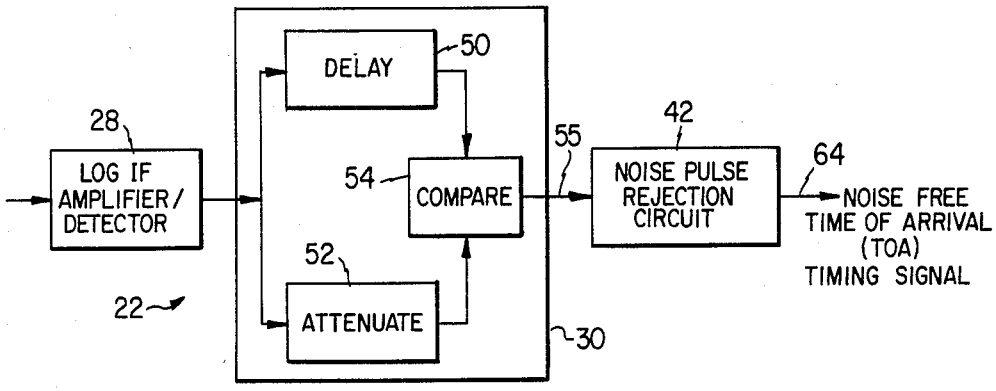
FIG. 2 is a block diagram of a portion of the DME/P receiver of FIG. 1, modified according to the present invention to include a noise pulse rejection circuit.
Figure 3A:
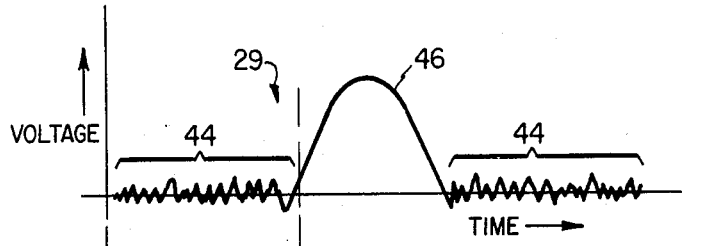
FIGS. 3A–3C are waveforms generated at various positions in the DME/P receiver of FIG. 2.

With reference now to FIG. 2, a block diagram is shown of a portion of the first signal processing channel 22 of the DME/P receiver 10 of FIG. 1, modified according to the present invention to include a noise pulse rejection circuit 42 connected at the output of the time-of-arrival detector 30. As discussed above with respect to FIG. 1, the first signal processing channel 22 includes the logarithmic amplifier/detector 28 which generates a logarithmic video output 29. The output waveform 29 is shown in FIG. 3A and includes noise components 44 and at least one DME interrogation pulse 46.

A proper response to the DME interrogation pulse 46 requires synchronization of the decoding circuits (not shown) in the transponder with the leading edge of the interrogation pulse. The "time-of-arrival" of the DME pulse 46 must therefore be detected. Referring back to FIG. 2, the DME/P receiver 10 includes the time-of-arrival detector 30 for this purpose. The time-of-arrival detector 30 includes a delay network 50, an attenuate network 52, and a compare network 54. In operation, the compare network 54 compares a delayed version of the DME pulse 46 generated by the delay network 50, to an attenuated version of the same pulse generated by the attenuate network 52. Pulse arrival is declared when the amplitude of the delayed version exceeds the amplitude of the attenuated version by a predetermined amount.

Although the channel 22 in FIG. 2 incorporates a logarithmic amplifier/detector 28, it should be appreciated that a linear amplifier/detector may be used as an alternative. If a linear detector is used, attenuate network 52 in FIG. 2 comprises a conventional resistor divider circuit. To the contrary, if a logarithmic detector is used in channel 22, the attenuate network 52 comprises a subtract circuit because subtraction of a logarithmic signal is equivalent to attenuation of a linear signal.

Figure 3B:
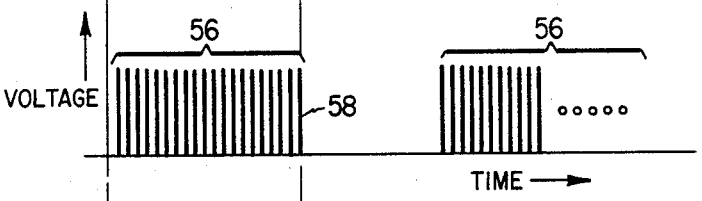

Time-of-arrival detector 30 generates outputs on line 55. Specifically, and with reference to FIG. 3B, detector 30 generates a plurality of time-of-arrival detector outputs 56 due to receiver noise, and a time-of-arrival detector output 58 upon detection of a leading edge of the DME pulse 46. As seen in FIG. 3B, the time-of-arrival detector outputs 56 due to receiver noise have substantially shorter periods than the time-of-arrival detector output 58 occurring upon the detection of the received DME pulse 46. The present invention exploits this difference in the time-of-arrival detector output periods to generate a useful timing signal for the remainder of the DME/P receiver decoding process.

Specifically, and referring back to FIG. 2, the first signal processing channel 22 includes the noise pulse rejection circuit 42 which receives the time-of-arrival detector outputs 56 and 58 from the time-of-arrival detector 30. In the preferred embodiment of the invention, the noise pulse rejection circuit 42 is a retriggerable circuit, such as a monostable multivibrator, which generates an output signal having first and second logic states. Once triggered, the monostable multivibrator circuit changes from a first logic state to a second logic state after a predetermined time period "T". Because it is retriggerable, however, any other input trigger during the time period "T" resets the timing sequence, and thus the output of the circuit remains in the first logic state until the predetermined time period has passed after the second input trigger.

Figure 3C:
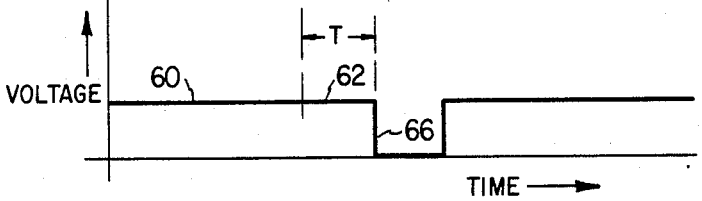

As noted above, in the first signal processing channel 22 of FIG. 2, the time-of-arrival detector outputs 56 due to receiver noise have a much shorter period than the time-of-arrival detector output 58 due to the detection of the leading edge of the DME pulse 46. Referring simultaneously to FIGS. 2 and 3C, if the desired DME pulse is not being received, then the time-of-arrival detector outputs 56 due to receiver noise continually reset the monostable multivibrator 42. Accordingly, the monostable multivibrator 42 never "times-out" and its output remains at a logic high, as represented by the portion 60 of the waveform of FIG. 3C. When the desired DME pulse 46 is received, however, the time-of-arrival detector outputs 56 disappear for the duration of the DME pulse 46, and the monostable multivibrator 42 "times-out" after the predetermined time period "T." This operation is represented by the portion 62 of the waveform in FIG. 3C. The output of the monostable multivibrator 42 is provided on line 64. In the preferred embodiment, the negative going edge 66 of the output waveform shown in FIG. 3C is then gated through the gate circuits 32 and 40 of FIG. 1 by the operation of the frequency discriminator circuit 12.

Accordingly, the present invention relates to a noise pulse rejection circuit for use in a pulse type time-of-arrival detection system, this system preferably employing a time-of-arrival detector in a DME/P receiver. In the preferred embodiment, the noise pulse rejection circuit is a precision retriggerable monostable multivibrator which is triggered by pulse detections. The circuit takes advantage of the fact that a time-of-arrival detector output due to the received DME pulse is always followed by a lack of time-of-arrival detector outputs due to receiver noise, since the former detection occurs early on after the leading edge of the relatively long DME pulse is detected. The presence of the DME pulse thus presents further noise detections from occurring for a period of time, allowing the monostable multivibrator 42 to "time-out". When the monostable multivibrator "times-out," the pulse detection is considered valid, and the negative going edge of the monostable multivibrator output is then used for the remainder of the decoding process.

Although the preferred embodiment of the present invention has been described in the context of a pulse type time-of-arrival detection system having a time-of-arrival detector in the DME/P receiver, the principle of the present invention is applicable to any pulse detection system that detects pulse time-of-arrival early on in the desired pulse waveform. Accordingly, the present invention is not deemed to be limited to a pulse type time-of-arrival detection system incorporating a DME/P receiver. Moreover, the noise pulse rejection circuit may comprise any retriggerable circuit.

Although the invention has been described in detail, it is to be clearly understood that the same is by way of illustration and example only and is not to be taken by way of limitation, the spirit and scope of the invention being limited only to the terms of the appended claims.

We claim:

1. A pulse-type time-of-arrival detection system for detecting an input signal including at least one pulse, comprising:

receiver means for receiving said input signal and generating an output signal proportional thereto;

detector means connected to said receiver means for receiving said output signal, and in response thereto generating first time-of-arrival detector outputs due to noise from said receiver means, and a second time-of-arrival detector output upon detection of the leading edge of said pulse, each of said first time-of-arrival detector outputs having a substantially shorter period than the period of said second time-of-arrival detector output; and means, triggered by said first and second time-of-arrival detector outputs, for generating a timing signal having first and second logic states, said timing signal normally changing from said first logic state to said second logic state after a predetermined time period "T," said time period "T" substantially longer than the period of each said first time-of-arrival detector outputs, such that said timing signal remains in said first logic state when said means is triggered by said first time-of-arrival detector outputs, but changes to said second logic state in said predetermined time period "T" when said means is triggered by said second time-of-arrival detector output.

2. The pulse type time-of-arrival detection system as described in claim 1 wherein said means is a retriggerable monostable multivibrator circuit which is reset to said first logic state upon reception of each time-of-arrival detector output.

3. The pulse type time-of-arrival detection system as described in claim 1 wherein said receiver means includes a logarithmic amplifier/detector circuit for generating a logarithmic video output proportional to said input signal.

4. The pulse type time-of-arrival detection system as described in claim 3 wherein said detector means includes a delay-attenuate-compare (DAC) detector circuit which receives said logarithmic video output generated by said logarithmic amplifier/detector circuit and in response thereto generates said first and second time-of-arrival detector outputs.

5. The pulse type time-of-arrival detection system as described in claim 1 wherein said timing signal includes a negative going edge which is used in said detection system for decoding purposes.

6. A pulse-type time-of-arrival detection system for detecting an input signal including at least one pulse, comprising:

a logarithmic amplifier/detector circuit for receiving said input signal and generating an output signal proportional thereto;

a delay-attenuate-compare (DAC) detector circuit connected to said logarithmic amplifier/detector circuit for receiving said output signal, and in response thereto generating first time-of-arrival detector outputs due to noise from said logarithmic amplifier/detector circuit, and a second time-of-arrival detector output upon detection of the leading edge of the pulse, each of said first time-of-arrival detector outputs due to receiver noise having a substantially shorter period than the period of said second time-of-arrival detector outputs; and a monostable multivibrator, triggered by said first and second time-of-arrival detector outputs, for generating a timing signal having first and second logic states, said timing signal normally changing from said first logic state to said second logic state after a predetermined time period "T," said time period "T" substantially longer than the period of each said time-of-arrival detector outputs due to receiver noise, such that said timing signal remains in said first logic state when said monostable multivibrator is triggered by said first time-of-arrival detector outputs, but changes to said second logic state in said predetermined time period "T" when said monostable multivibrator is triggered by said second time-of-arrival detector output;

said timing signal including a negative going edge which is used in said pulse type time-of-arrival detection system for decoding purposes.

7. A method for generating a timing signal in a pulse type time-of-arrival detection system, comprising the steps of;

receiving an input signal including at least one pulse;

generating an output signal proportional to said input signal, said output signal including noise components;

generating first time-of-arrival detector outputs due to said noise components, and a second time-of-arrival detector output upon detection of the leading edge of said pulse, each of said first time-of-arrival detector outputs having a substantially shorter period than the period of said second time-of-arrival detector output; and applying said first and second time-of-arrival detector outputs to a retriggerable circuit to generate a timing signal having first and second logic states, said timing signal normally changing from said first logic state to said second logic state after a predetermined time period "T," said time period "T" substantially longer than the period of each of said first time-of-arrival detector outputs, such that said timing signal remains in said first logic state when said first time-of-arrival detector outputs are applied to said retriggerable circuit, but changes to said second logic state in said predetermined time period "T" when said second time-of-arrival detector output is applied to said retriggerable circuit.

8. The method for generating a timing signal in a pulse type time-of-arrival detection system as described in claim 7, further including the step of:

using said timing signal in said pulse type time-of-arrival detection system for decoding purposes.

* * * * *